US011824304B2

(12) United States Patent
Sena et al.

(10) Patent No.: US 11,824,304 B2
(45) Date of Patent: Nov. 21, 2023

(54) ELECTRICAL CONNECTOR

(71) Applicant: System One Innovations Inc., Rocky Hill, CT (US)

(72) Inventors: Michael F. Sena, Newington, CT (US); Michael Cortese, Genoa, IL (US)

(73) Assignee: System One Innovations Inc., Rocky Hill, CT (US)

( * ) Notice: Subject to any disclaimer, the term of this patent is extended or adjusted under 35 U.S.C. 154(b) by 85 days.

(21) Appl. No.: 17/647,156

(22) Filed: Jan. 5, 2022

(65) Prior Publication Data

US 2023/0216241 A1 Jul. 6, 2023

(51) Int. Cl.
*H01R 13/625* (2006.01)
*H01R 13/627* (2006.01)

(52) U.S. Cl.
CPC ..... *H01R 13/625* (2013.01); *H01R 13/6273* (2013.01)

(58) Field of Classification Search
CPC .... H01R 24/58; H01R 24/00; H01R 2103/00; H01R 13/625; H01R 13/6273
USPC ..... 439/580, 668, 669, 352
See application file for complete search history.

(56) References Cited

U.S. PATENT DOCUMENTS 2,353,719 A * 7/1944 Goldfield ..... H02G 15/04 174/75 D
2,762,025 A * 9/1956 Melcher ..... H01R 24/564 174/359
2,833,997 A 5/1958 Brown
3,100,655 A 8/1963 Work
3,364,455 A 1/1968 Nodfelt
3,701,086 A * 10/1972 Somerset ..... H01R 24/562 174/75 C
4,307,926 A * 12/1981 Smith ..... H01R 24/562 439/607.52
4,375,310 A 3/1983 Robinson et al.
4,531,802 A 7/1985 Tomsa
4,674,809 A * 6/1987 Hollyday ..... H01R 13/7197 439/620.09
4,799,902 A * 1/1989 Laudig ..... H01R 24/562 439/585

(Continued)

FOREIGN PATENT DOCUMENTS

EP 187887 A1 7/1986
WO WO2019226800 A1 11/2019
WO WO2020019499 A1 1/2020

*Primary Examiner* — Gary F Paumen
(74) *Attorney, Agent, or Firm* — Fish & Richardson P.C.

(57) ABSTRACT

An electrical connector includes a male connector and a female connector. The male connector has a housing, a first tubular conductor, a second tubular conductor, and an inner conductor. The first tubular conductor is carried by the housing and has an exposed first cylindrical contact surface. The second tubular conductor has an exposed second cylindrical contact surface of a smaller diameter than the first cylindrical contact surface. The inner conductor has an exposed contact surface that has a smaller diameter than the second cylindrical contact surface. The female connector has a non-conductive female connector housing and three electrical contacts carried by the female connector housing. Each of the three electrical contacts electrically connect, with the male connector engaged with the female connector, to a respective one of the contact surfaces of the male connector.

17 Claims, 9 Drawing Sheets

(56) References Cited

U.S. PATENT DOCUMENTS 4,917,525 A 4/1990 Duncan
5,409,403 A * 4/1995 Falossi ..... H01R 24/38 439/736
5,685,730 A 11/1997 Cameron et al.
6,561,848 B1 * 5/2003 Khemakhem ..... H01R 9/0512 439/550
6,575,786 B1 * 6/2003 Khemakhem ..... H01R 13/5804 439/578
6,609,924 B2 8/2003 Zeiler et al.
6,783,382 B2 8/2004 Felps
7,322,859 B2 1/2008 Evans
7,455,543 B2 11/2008 Natter et al.
7,758,370 B1 * 7/2010 Flaherty ..... H01R 13/6275 439/352
8,087,954 B2 * 1/2012 Fuchs ..... H01R 13/6275 439/352
9,039,436 B2 5/2015 Tiberghien et al.
9,548,558 B1 1/2017 Hsu et al.
10,148,047 B2 12/2018 Wimmer et al.
10,490,937 B1 11/2019 Su et al.
10,770,808 B2 9/2020 Youtsey
11,081,838 B2 8/2021 Wendt et al.
2002/0052148 A1 * 5/2002 Nagata ..... H01R 24/58 439/668
2005/0215113 A1 * 9/2005 Khemakhem ..... H01R 24/542 439/580
2009/0220196 A1 * 9/2009 Daane ..... H01R 24/58 439/577
2010/0197172 A1 * 8/2010 Yudate ..... H01R 12/712 439/669
2013/0121648 A1 * 5/2013 Hung ..... G02B 6/4293 385/79
2013/0244485 A1 * 9/2013 Lam ..... H01R 24/58 439/580
2015/0244116 A1 * 8/2015 Los ..... H01R 24/58 439/669
2021/0083430 A1 3/2021 Bowen et al.
2021/0194174 A1 6/2021 Wu et al.

* cited by examiner

ELECTRICAL CONNECTOR

FIELD OF DISCLOSURE

This disclosure relates to electrical connectors, and more particularly to inline or cable connectors.

BACKGROUND

Electrical connectors are devices used to electrically connect or disconnect electronic devices and appliances from power sources or other electronic components. Electrical connectors can be used to power electronic components and transmit information. Most electrical cable connectors have a male component such as a plug and a female component such as a socket. Methods and equipment for improving electrical cable connectors are sought.

SUMMARY

Implementations of the present disclosure include a bayonet electrical connector that includes a male connector and a female connector. The male connector has a non-conductive connector housing, a first tubular conductor, a second tubular conductor, and an inner conductor. The first tubular conductor is carried by the connector housing and includes an exposed first cylindrical contact surface. The second tubular conductor is carried by the connector housing and is electrically isolated from the first tubular conductor. The second tubular conductor has an exposed second cylindrical contact surface of a smaller diameter than, and axially spaced from, the first cylindrical contact surface. The inner conductor is carried by the connector housing and is electrically isolated from the first and second tubular conductors. The inner conductor includes a third exposed contact surface spaced axially from the first and second cylindrical contact surfaces. The inner conductor has a smaller diameter than the second cylindrical contact surface. The female connector has a non-conductive female connector housing and three electrical contacts axially spaced from each other along a bore of the female connector and carried by the female connector housing. Each of the three electrical contacts electrically connect, with the male connector engaged with the female connector, to a respective one of the contact surfaces of the male connector.

In some implementations, the second tubular conductor is arranged concentric with respect to the first tubular conductor, and the inner conductor is arranged concentric with respect to the second tubular conductor. In some implementations, the first tubular conductor is electrically coupled to a first electrical wire of the male connector. The second tubular conductor is electrically coupled to a second electrical wire of the male connector. The inner conductor includes a pin electrically coupled to a third electrical wire of the male connector. In some implementations, the first tubular conductor includes a first tab extending from a rim of the first tubular conductor opposite the first cylindrical contact surface and electrically coupled to the first electrical wire. The second tubular conductor includes a second tab opposing the first tab and extending from a rim of the second tubular conductor opposite the second cylindrical contact surface. The second tab is electrically coupled to the second electrical wire.

In some implementations, the second tubular conductor extends beyond the first cylindrical contact surface with respect to the non-conductive connector housing of the male connector, and the inner conductor extends beyond the second cylindrical contact surface with respect to the non-conductive connector housing of the male connector.

In some implementations, the male connector also has a first tubular insulator disposed between and in contact with the first tubular conductor and the second tubular conductor. The male connector also has a second tubular insulator disposed between and in contact with the second tubular conductor and the inner conductor.

In some implementations, the female connector includes an internal engagement sleeve that has a latch configured to engage, with the male connector inserted into the female connector, a latch cavity of the connector housing of the male connector to secure the female connector to the male connector. In some implementations, the electrical contacts are spring-loaded electrical contacts attached to the internal engagement sleeve. In some implementations, the female connector has a spring-loaded sleeve disposed outside the internal engagement sleeve. The spring-loaded sleeve moves along a central longitudinal axis of the female connector housing such that movement toward an electrical cable of the female connector compresses a spring of the spring-loaded sleeve and moves the latch to disengage the latch from the latch cavity of the male connector. In some implementations, the spring-loaded sleeve includes an inwardly projecting shoulder defining a tip configured to push, by movement of the spring-loaded sleeve toward the electrical cable of the female connector, the latch away from the latch cavity until the latch disengages the latch cavity. In some implementations, the bayonet electrical connector further includes a housing that has an outer flange and an inner tube extending from the outer flange and disposed at least partially inside the spring-loaded sleeve. The spring is disposed between a shoulder of the spring-loaded sleeve and a wall of the internal engagement sleeve such that, absent an external force, the spring pushes the shoulder of the spring-loaded sleeve toward the outer flange.

Implementations of the present disclosure also include an electrical connector that includes a male connector and a female connector. The male connector has a non-conductive housing, a first electrical conductor residing at least partially inside the non-conductive housing and including a first exposed contact surface defining a first outer diameter, and a second electrical conductor. The second electrical conductor resides at least partially inside the first electrical conductor and is electrically isolated from the first electrical conductor. The second electrical conductor has a second contact surface defining a second outer diameter smaller than the first outer diameter. The female connector includes an outer housing and two electrical contacts residing inside the outer housing. Each of the two electrical contacts electrically connect, with the male connector engaged with the female connector, to a respective one of the contact surfaces of the male connector.

In some implementations, the first electrical conductor includes a tubular body carried by the non-conductive housing and the second electrical conductor includes a second tubular body carried by the non-conductive housing. The male connector also has an insulating layer disposed between the first and second electrical conductors. In some implementations, the male connector further includes a third electrical conductor electrically isolated from and concentric with respect to the second electrical conductor. The third electrical conductor has a third contact surface defining a third outer diameter smaller than the second outer diameter. In some implementations, the third electrical conductor is a pin axially spaced from and residing partially inside the second electrical conductor. The third contact surface is a pin end that extends beyond the second contact surface.

In some implementations, the female connector includes an engagement sleeve including a snap latch that engages, with the male connector inserted into the female connector, an external latch cavity of the male connector to secure the female connector to the male connector. In some implementations, the female connector includes a spring-loaded sleeve disposed outside the engagement sleeve and configured to move along a central longitudinal axis of the outer housing such that movement toward an electrical cable of the female connector compresses a spring of the spring-loaded sleeve and moves the latch to disengage the latch from the latch cavity of the male connector. In some implementations, the spring-loaded sleeve includes an inwardly projecting shoulder defining a tip configured to push, by movement of the spring-loaded sleeve toward the electrical cable of the female connector, the latch away from the latch cavity until the latch disengages the latch cavity.

Implementations of the present disclosure also include a method of using an electrical connector. The method includes inserting a male electrical connector into a female electrical connector. The male electrical connector has a non-conductive housing, a first tubular conductor including a first contact surface defining a first outer diameter, and a second tubular conductor electrically isolated from and radially spaced from the first tubular conductor. The second tubular conductor has a second contact surface that defines a second outer diameter smaller than the first outer diameter. The female electrical connector has an outer housing that includes a latch and two electrical contacts that reside inside the outer housing. Each of the two electrical contacts are configured to electrically connect to a respective one of the contact surfaces of the male connector. The method also includes continuing to insert the male electrical connector into the female electrical connector until the latch of the female electrical connector engages a latch cavity of the male electrical connector.

In some implementations, the method further includes pulling a sleeve of the female electrical connector away from the male electrical connector, disengaging the latch and thereby disconnecting the female electrical connector from the male electrical connector.

Particular implementations of the subject matter described in this specification can be implemented so as to realize one or more of the following advantages. For example, the male connector of an electrical connector can be quickly and securely connected to the female connector by simply pushing the male connector into a receptacle of the female connector. Additionally, the male connector can be quickly disconnected from the female connector by simply pulling a sleeve of the female connector and then pulling the male connector away from the female connector. Moreover, the tubular conductors of the male connector and the spring-loaded contacts of the female connector allow the male and female connectors to make a reliable electrical contact and to remain in electrical contact during 360 degrees of rotation of one of the connectors with respect to the other one of the connectors.

DETAILED DESCRIPTION

Bayonet-style electrical connectors consist of male and female connectors. The female connector receives the male connector to form the electrical connection. To engage the connectors or maintain the connectors engaged, an outer sleeve of one of the connectors makes a bayonet-style connection with the other of the connectors. For example, a cylindrical housing of one of the connectors has a radial pin and the other connector has a slot (e.g., an L-shaped slot) that receives the radial pin until the pin reaches the end of the slot. A spring of one of the connectors can push the pin against the end of the slot to maintain the connectors engaged. Bayonet-style electrical connectors can provide a reliable and secure electrical connection between the connectors. However, repeatedly connecting and disconnecting bayonet-style electrical connectors can be tedious and difficult. The electrical connector of the present disclosure simplifies the process of making a bayonet-style electrical connection while maintaining or increasing the reliability and accuracy of the electrical connection compared to typical bayonet-style electrical connectors.

Figure 1:
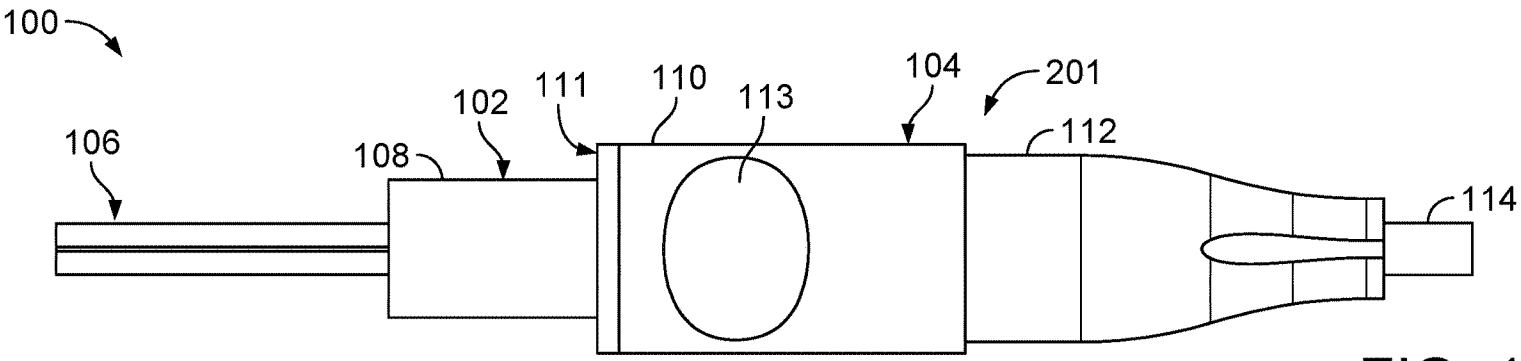
FIG. 1 is a side view of a bayonet electrical connector.

FIG. 1 shows a bayonet electrical connector 100 that includes a male electrical connector 102 and a female electrical connector 104. The male electrical connector 102 has a non-conductive connector housing 108 and an electrical cable 106 attached to the housing 108. The female connector 104 has female connector housing 201 (e.g., a non-conductive housing) that includes a movable sleeve 110, a handle 112 attached to the sleeve 110, and an electrical cable 114 attached to the handle 112. The sleeve 110 has an opening that receives the connector housing 108 of the male connector 102 to form the electrical connection. The electrical connection can be formed by pushing the housing 108 of the male connector 102 into the female connector housing 201.

As further described in detail below with respect to FIGS. 8-9, the female connector 104 has an internal latch that engages the male connector housing 108 to retain the male connector 102 and thus maintain the electrical connection. The internal latch can engage the male connector housing 108 once the housing 108 has been pushed far enough into the female connector housing 201. The sleeve 110 can be a spring-loaded sleeve that is movable toward the cable 114 of the female connector 104 to undo the connection. To disconnect the connectors 102 and 104, the sleeve 110 is pulled back to move the internal latch and undo the connection. The sleeve 110 can have an indentation 113 for easier gripping of the sleeve 110 when pulling the sleeve 110.

Figure 2:
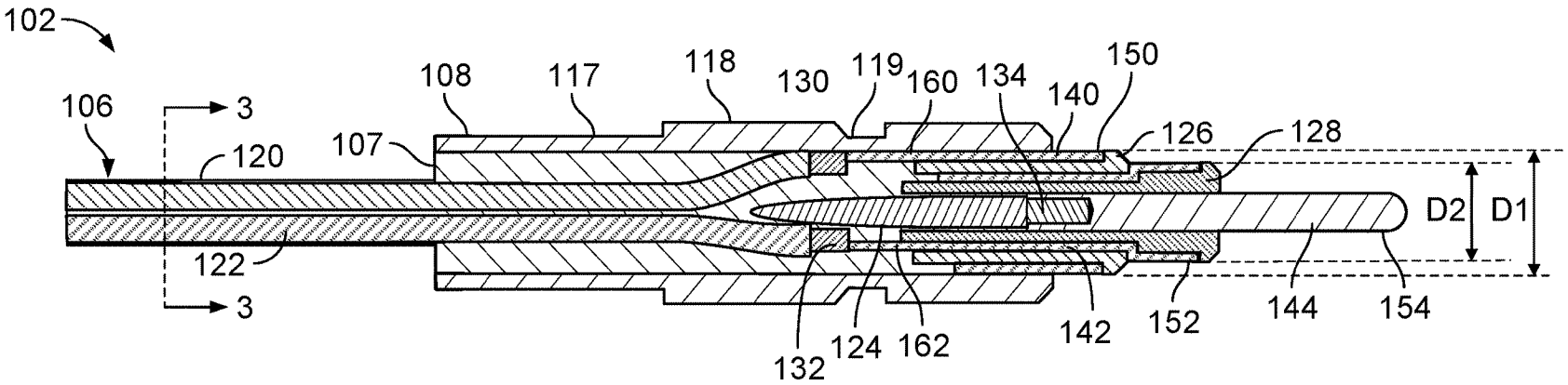
FIG. 2 is a side cross-sectional view of a male connector of the bayonet electrical connector of FIG. 1.

FIG. 2 is a side cross-sectional view of a male connector 102. The male connector 102 includes a first or outer tubular conductor 140 carried by the connector housing 108. For example, the first tubular conductor 140 can be adhered to the inner surface of the connector housing 108. The first tubular conductor 140 is an electrical conductor with an exposed first cylindrical contact surface 150. The cylindrical contact surface 150 makes an electrical connection with a respective interior contact of the female connector 104.

The male connector 102 also includes a second or middle tubular conductor 142 similar to the first tubular conductor 140. The second tubular conductor 142 can be carried by the connector housing 108 (e.g., carried by the first tubular conductor 140) and is electrically isolated from the first tubular conductor 140. The second tubular conductor 142 has an exposed second cylindrical contact surface 152. The second cylindrical contact surface 152 has an outer diameter "D2" that is smaller than the outer diameter "D1" of the cylindrical contact surface 150 of the first tubular conductor 140. The second cylindrical contact surface 152 is axially spaced from the first cylindrical contact surface 150.

The male connector 102 also includes a third or inner conductor 144. The inner conductor 144 can be carried by the connector housing 108 (e.g., carried by the second tubular conductor 142) and is electrically isolated from the first and second tubular conductors 140, 142. The inner conductor 144 has a third exposed contact surface 154 spaced axially from the first and second cylindrical contact surfaces 150, 152. The inner conductor 144 has an outer diameter "D3" that is smaller than the outer diameter "D2" of the second cylindrical contact surface 152. In some implementations, the male connector 102 can include two conductors or more than three conductors.

The conductors 140, 142, and 144 are axially spaced from each other. The conductors 140, 142, and 144 can be concentric, with the second tubular conductor 142 disposed partially inside the first tubular conductor 140 and the inner conductor 144 disposed partially inside the second tubular conductor 142. The tubular conductors 140 and 142 can be, for example, in the shape of a round tube, a square (or polygonal) tube, or a helical tube. In some implementations, concentric is referred to two or more conductors sharing a common center or their centers being substantially close to each other, allowing for engineering tolerances. For example, the second tubular conductor 142 can be concentric with respect to the first tubular conductor 140, and the inner conductor 144 is arranged concentrically with respect to the first and second tubular conductors 140, 142.

The male connector 102 also includes insulating layers between each conductor. For example, the male connector has a first insulating layer 126 (e.g., a tubular insulator) disposed between and in contact with the first tubular conductor 140 and the second tubular conductor 142. The male connector 102 also includes an insulating layer 128 (e.g., a tubular insulator) disposed between the second tubular conductor 142 and the inner conductor 144. The insulating layers 126 and 128 electrically isolate the conductors from each other.

Figure 4:
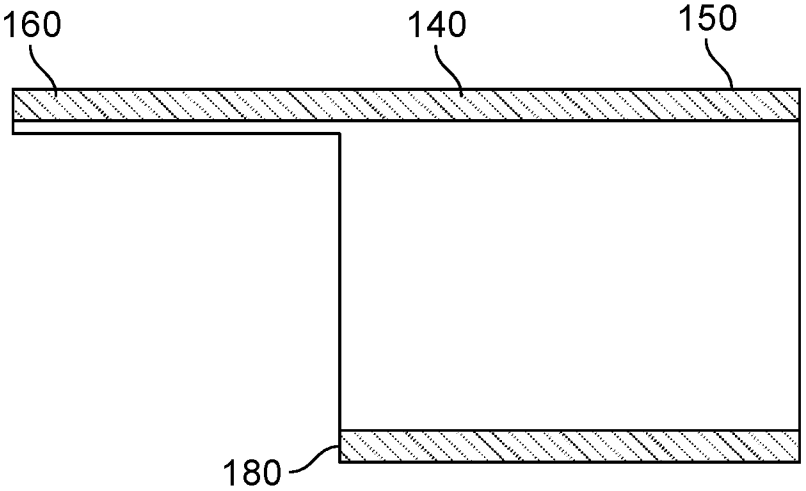
FIG. 4 is a side cross-sectional view of a first conductor of the male connector of FIG. 2.
Figure 5:
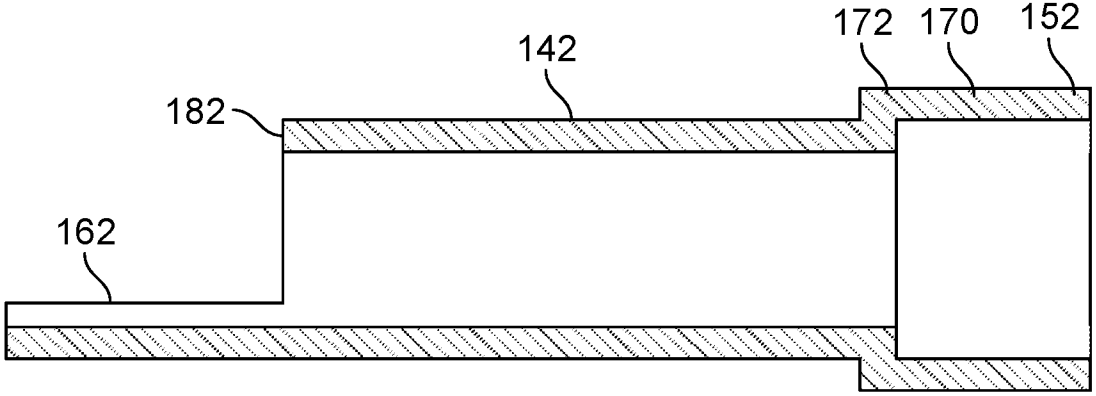
FIG. 5 is a side cross-sectional view of a second conductor of the male connector of FIG. 2.
Figure 6:
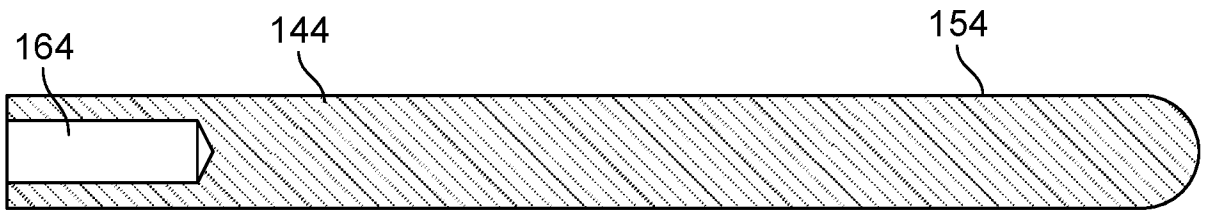
FIG. 6 is a side cross-sectional view of a third conductor of the male connector of FIG. 2.

The first tubular conductor 140 is electrically coupled to a first electrical wire 120 of the cable 106. For example, referring also to FIG. 4, the first tubular conductor 140 has a tab 160 that extends from a rim 180 of the tubular conductor 140 opposite the electrical contact surface 150. As shown in FIG. 2, the tab 160 is soldered or otherwise in electrical contact with a conductor 130 of the first wire 120. Similarly, the second tubular conductor 142 is electrically attached to a second wire 122 of the cable 106. For example, referring also to FIG. 5, the second tubular conductor 142 has a tab 162 that extends from a rim 182 of the second tubular conductor 142 opposite the second tubular contact surface 152. The tab 162 is soldered or otherwise in electrical contact with a conductor 132 of the second wire 122. The contact surface 152 of the second tubular conductor 142 can include an enlarged tubular portion 170 with a shoulder 172 that helps retain the insulating layer between the first and second tubular conductors. As shown in FIG. 2, the inner conductor 144 is electrically attached to a third wire 124 of the cable 106. For example, referring also to FIG. 6, the inner conductor 144 can have a hole or recess 164 that receives the tip of a conductor 134 of the third electrical wire 124. The inner conductor 144 can be in the form of a pin, with the contact surface 154 including the tip or end of the pin.

As further described in detail below with respect to FIGS. 8 and 9, the second tubular conductor 142 (and the second contact surface 152) extends beyond the first cylindrical contact surface 150 to form, with a respective contact of the female connector 104, an electrical connection. The inner conductor 144 142 extends beyond the second cylindrical contact surface 152 to reach the most inner contact of the female connector 104. As shown in FIG. 2, the housing 108 of the male connector 102 can have a thin portion 117 and a thick or wide portion 118. The thick portion 118 can have a latch cavity or groove 119 that receives a latch of the female connector 104.

Figure 3:
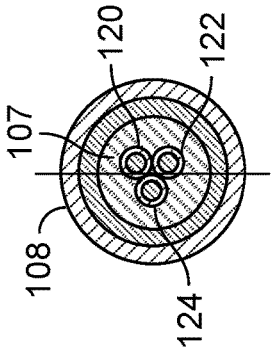
FIG. 3 is a cross-sectional view of the male connector of FIG. 2, taken along line 3-3 in FIG. 2.

As shown in FIG. 3, the three electrical wires 120, 122, 124 can be adjacent to each other and surrounded, inside the housing 108, by an electrically insulating layer 107 such as an epoxy. The epoxy can also help retain the wires in place inside the housing 108 to prevent the cable conductors 130, 132, 134 from contacting each other.

Figure 7:
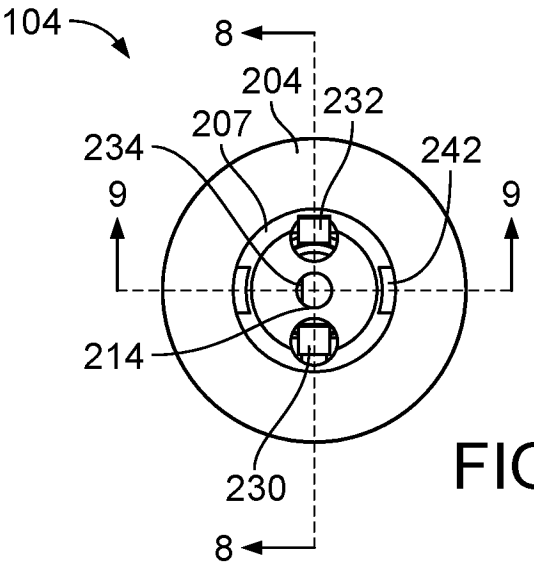
FIG. 7 is an end view of a female connector of the bayonet electrical connector of FIG. 1.

FIG. 7 depicts an end view (e.g., a back view) of the female connector 104. FIG. 8 is a cross-sectional view of the female connector 104 taken along line 8-8 and FIG. 9 is a cross-sectional view taken along line 9-9. As shown in FIGS. 7 and 8, the female connector 104 has a retaining housing 204 with a bore 207 that receives the male connector 102. Inside the bore 207, the female connector has three electrical contacts 230, 232, 234 axially spaced from each other along the bore 207 of the female connector 104. Each of the three electrical contacts 230, 232, 234 electrically connect, with the male connector 102 plugged into the female connector 104, to a respective one of the contact surfaces of the male connector 102.

Figure 8:
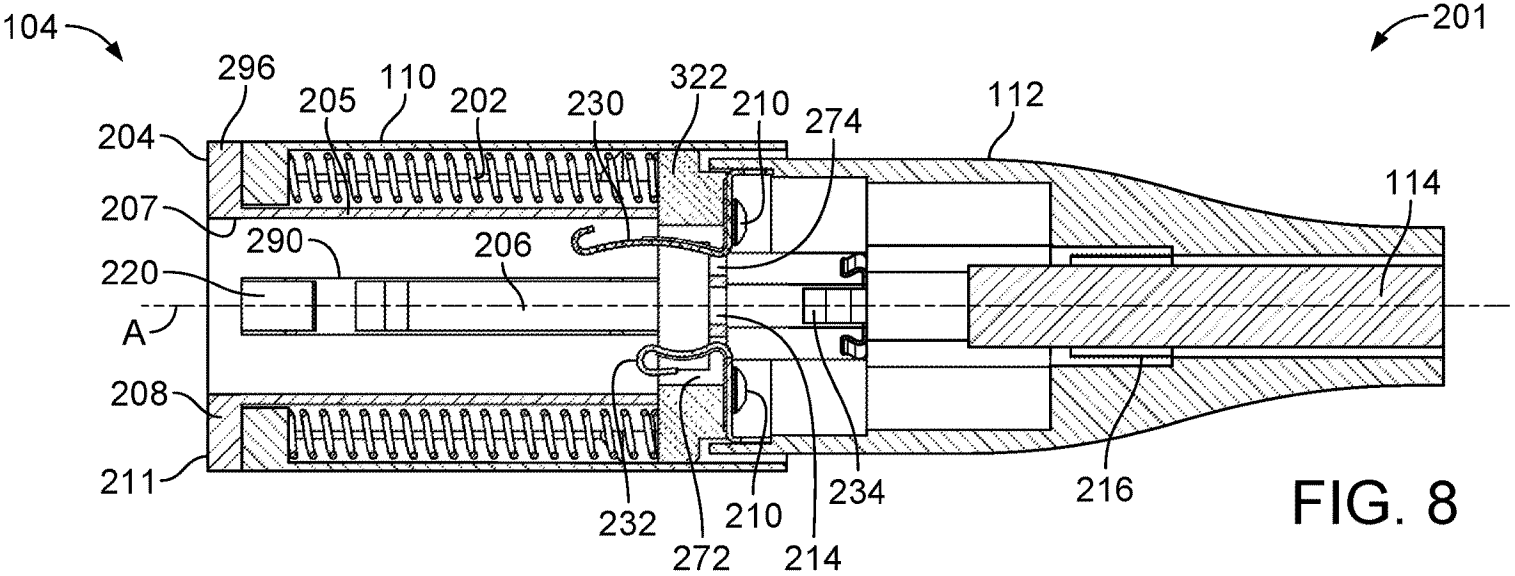
FIG. 8 is a cross-sectional view of the female connector of FIG. 7, taken along line 8-8 in FIG. 7.

Referring to FIG. 8, the female connector has a connector housing 201 that can include a handle 112, an internal engagement sleeve 206, the retaining housing 204, and the outer sleeve 110. The internal engagement sleeve or contact carrier 206, the retaining housing 204, and outer sleeve 110 can be non-conductive or conductive. However, the handle 112 is non-conductive and can be made of plastic or a similar material. The connector housing 201 carries the electrical contacts 230, 232, 234. The handle 112 includes a cable crimp ring 216 that retains a cable 114 of the female connector 104 to the handle 112. The cable 114 is electrically coupled to the electrical contacts 230, 232, 234.

Figure 9:
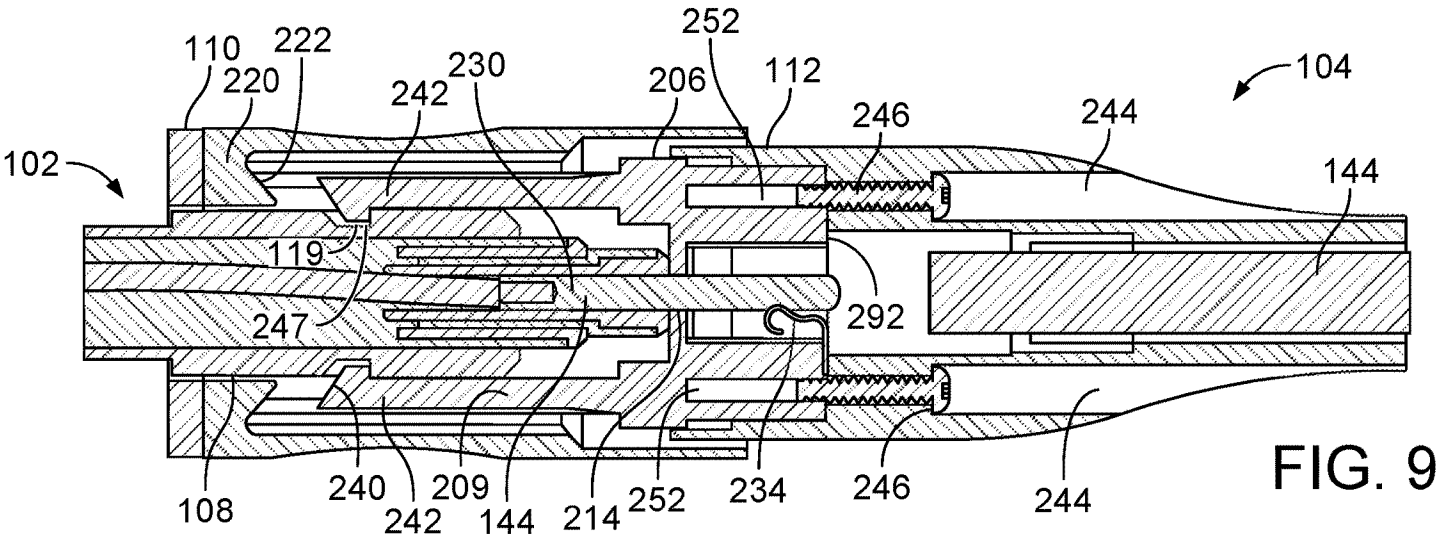
FIG. 9 is a cross-sectional view of the female connector of FIG. 7, taken along line 9-9 in FIG. 7 and with the male connector plugged into the female connector.

FIG. 9 shows the male connector 102 connected to the female connector 104. FIG. 9 depicts the cross-sectional view of the female connector along line 9-9 in FIG. 7. As shown, the internal engagement sleeve 206 of the female connector 104 has one or more latches 242 that engage, with the male connector 102 inserted into the female connector 104, the latch cavity 119 (or cavities) of the connector housing 108. The latches 242 secure the female connector 104 to the male connector 102 and prevent the male connector 102 from being pulled and unplugged from the female connector 104. For example, the latches 242 can be spring-loaded or snap latches. The latches 242 includes a cantilever beam 209 with a bump 247 at the end of the beam 209 that deflects and snaps into the latch cavity 119 of the male connector 102. When the bump 247 is inside the latch cavity 119, the latch 242 secures the two connectors together and prevents the male connector 102 from being pulled and disconnected from the female connector 104.

Figure 11:
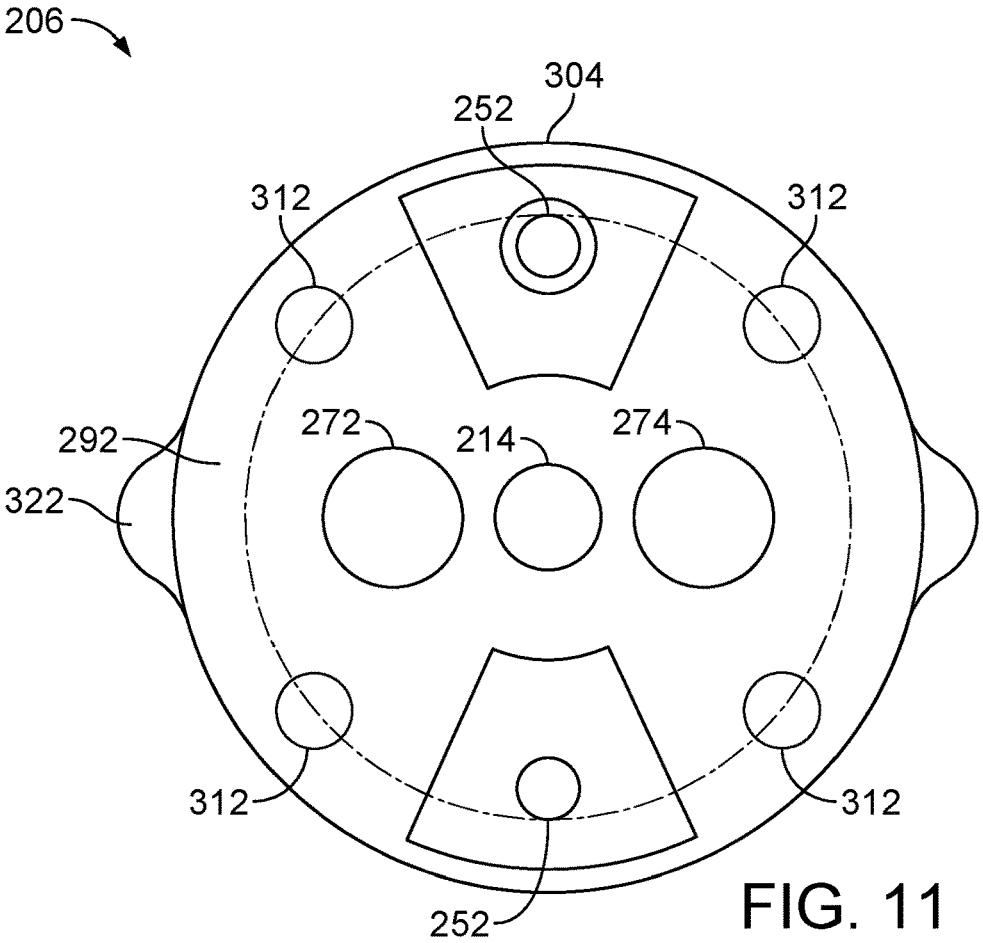
FIG. 11 is an end view of a contact carrier of the female connector of FIG. 7.

Referring also to FIG. 11, the internal engagement sleeve 206 has an interface surface 292 opposite the latches 242 that interfaces with the handle 112. The interface surface 292 has two holes 252 (e.g., threaded holes) that each receives a mechanical fastener 246 (e.g., a screw) that secures the handle 112 to the internal engagement sleeve 206. As shown in FIG. 9, the innermost electrical contact 234 can be secured between the interface surface 292 and the handle 112 by one of the mechanical fasteners 246. The innermost contact 234 contacts the inner conductor 144 of the male connector 102. The inner conductor 144 extend through a central hole 214 of the internal engagement sleeve 206 to reach the innermost contact 234 of the female connector 104.

Figure 12:
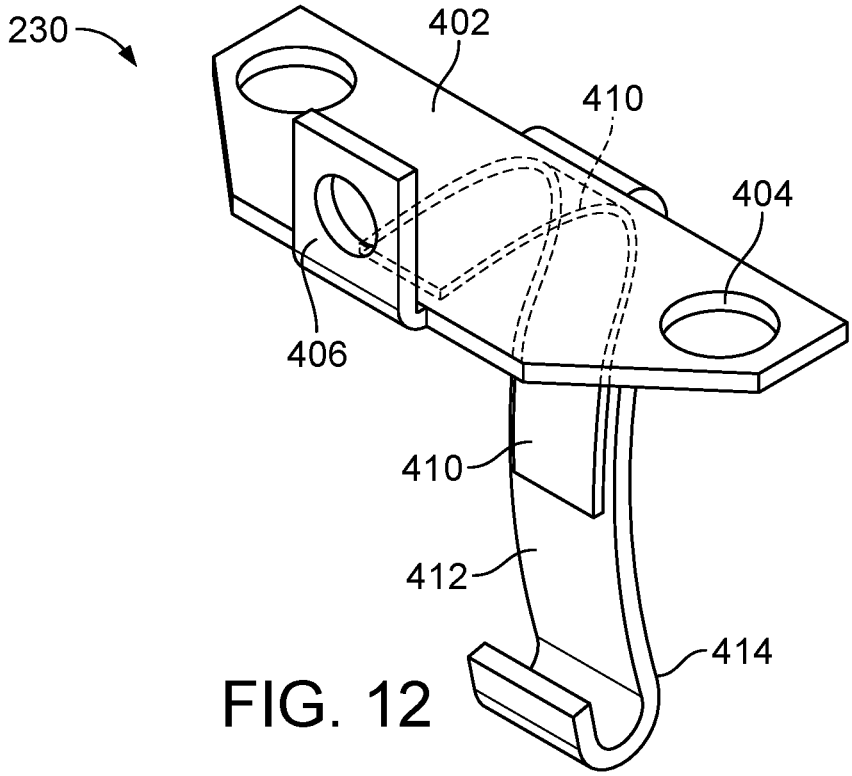
FIG. 12 is a perspective view of an electrical contact of the female connector of FIG. 7.

Referring to FIGS. 8 and 11, the interface surface 292 of the internal engagement sleeve 206 also includes four holes 312 (e.g., threaded holes). Each hole 312 receives a mechanical fastener 210 (e.g., a screw) that secures a respective one of the first and second electrical contacts 230, 232 to the internal engagement sleeve 206. For example, referring also to FIG. 12, the first electrical contact 230 has a flange 402 with holes 404 that each align with respective holes 312 of the internal engagement sleeve 206. The first electrical contact 230 also has a spring-loaded arm 412 that extends from the flange 402 and includes a contact surface 414. The arm 412 can be reinforced by a plate 410 that curves with the arm 412. The arm 412 contacts the tubular contact surface of the first tubular conductor of the male connector 102. When the first electrical contact 230 is secured to the internal engagement sleeve 206, the arm 412 extends through one of the contact holes 272, 274 of the internal engagement sleeve 206 to a location where a respective conductor of the male connector arrives when plugged into the female connector 104. The second electrical contact is similar to the first electrical contact with the main exception that the arm of the second electrical contact is shorter than the arm 412 of the first electrical contact 230. Thus, when the second electrical contact is attached to the internal engagement sleeve 206, the arm of the second electrical contact extends through the other one of the contact holes 272, 274 to a location where a respective conductor of the male connector arrives when plugged into the female connector 104.

Figure 10:
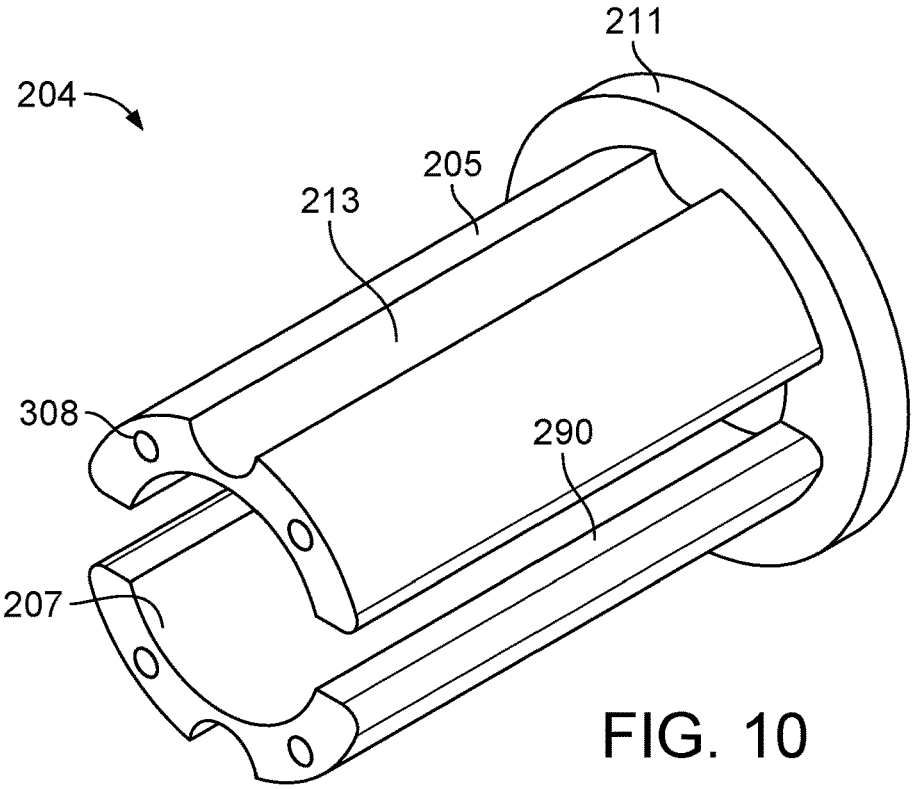
FIG. 10 is a perspective view of an inner housing of the female connector of FIG. 7.

Referring to FIGS. 8 and 10, the retaining housing 204 has an outer flange 211 and an inner tube 205 extending from the outer flange 211. The inner tube 205 resides at least partially inside the spring-loaded sleeve 110. The inner tube 205 has two slots or gaps 290 that extend the entire length of the tube 205 to receive the latches 242 of the internal engagement sleeve 206. The inner tube 205 has holes 308 (e.g., threaded holes) that receive the mechanical fasteners 210 to secure the retaining housing 204 to the internal engagement housing 206. The bore 207 of the inner tube 205 forms the bore of the female connector 104. The inner tube 205 has two round grooves 213 that receive the two springs of the spring-loaded sleeve 110.

Referring to FIG. 8, the springs 202 of the spring-loaded sleeve 110 are disposed between a shoulder 296 of the spring-loaded sleeve 110 and a wall 322 (e.g., a tab) of the internal engagement sleeve 206 such that, absent an external force, the springs 202 push the shoulder 296 of the spring-loaded sleeve 110 against the outer flange 211 of the retaining housing 204.

The spring-loaded sleeve 110 moves along a central longitudinal axis "A" of the female connector housing 201 such that movement toward the electrical cable 114 of the female connector 104 compresses the springs 202 of the spring-loaded sleeve 110. Additionally, as shown in FIG. 9, sufficient movement of the sleeve 110 in the same direction moves the latches 242 to disengage the latch 242 from the latch cavity of the male connector 102. For example, the spring-loaded sleeve 110 can have an inwardly-projecting shoulder 220 that extends into the slot of the retaining housing 204. The inwardly-projecting shoulder 220 defines a tip 222 (e.g., a tapered tip) that pushes or opens, by movement of the spring-loaded sleeve 110 away from the male electrical connector, the latch bump 247 away from the latch cavity of the male connector 102 until the latch bump 247 disengages the latch cavity. Once the latch cavity is disengaged, the male connector 102 can be quickly disconnected from the female connector 104 by pulling the male connector 102 away from the female connector 104.

Figure 13A:
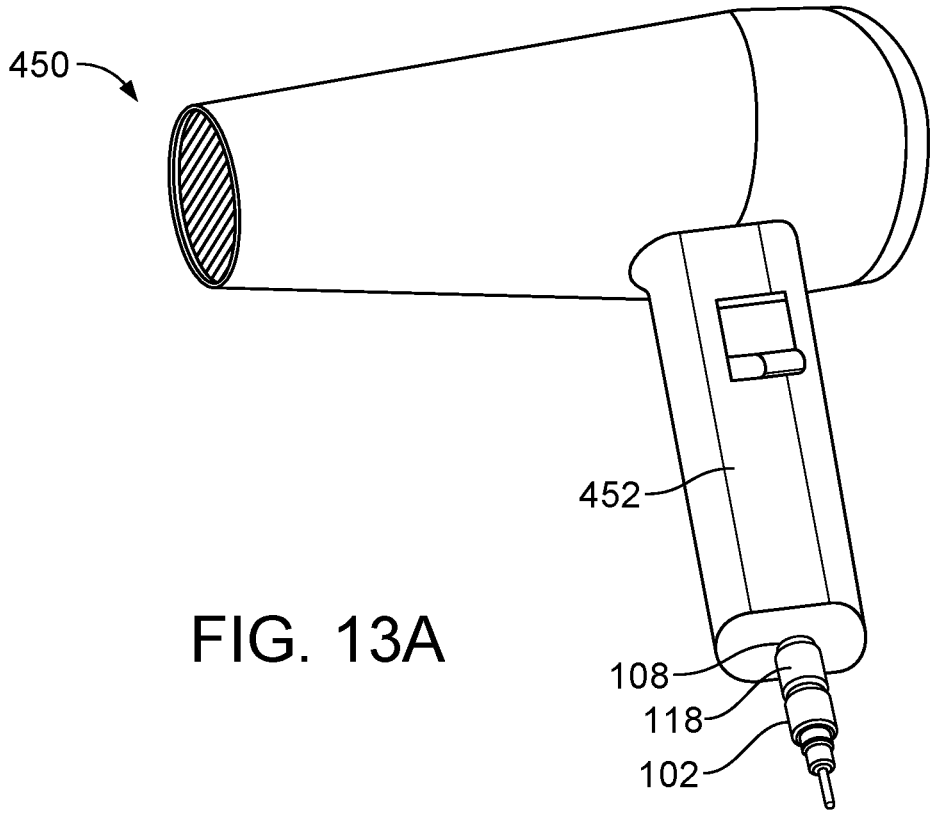
FIG. 13A is a schematic, perspective view of a male connector implemented in an electrical device according to a first implementation of the present disclosure.

FIG. 13A depicts a male connector 102 implemented in an electric blow dryer 450. The blow drier 450 has a handle 452 and a male connector 102 that extends from a lower surface of the handle 452. The outer housing 108 of the male connector 102 can be formed as part of the appliance housing (e.g., as part of the handle 452). Alternatively, the housing 108 can be molded separately and then permanently attached to the appliance housing (e.g., with an adhesive or by sonic welding). The wide portion 118 of the housing 108 can stick out of the handle 452 to allow the male connector 102 to be fully inserted into the female connector 104. In some implementations, the male connector 102 can be attached to the appliance 450 by a length of cable. The female connector can be part of the power cord (not shown) of the blow drier 450. In some implementations, the female connector can be attached to the blow drier 450 and the male connector 102 can be attached to the power cord.

Figure 13B:
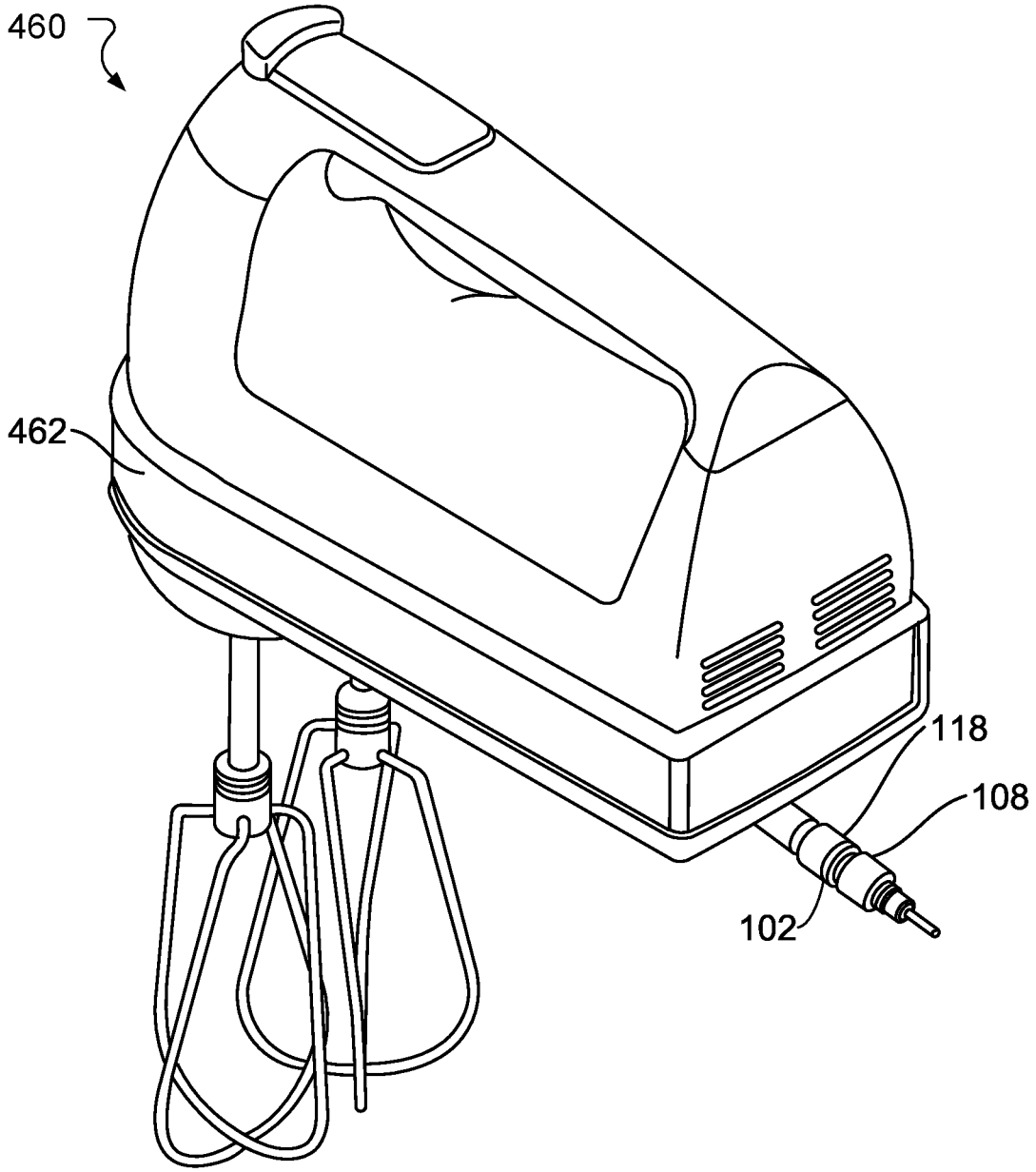
FIG. 13B is a schematic, side view of a male connector implemented in an electrical device according to a second implementation of the present disclosure.

FIG. 13B depicts a male connector 102 implemented in a food mixer 460 (e.g., a hand-held cake mixer). The food mixer 460 has a base 462 and a male connector 102 that extends from a back surface of the base 462. The outer housing 108 of the male connector 102 can be formed as part of the appliance housing (e.g., as part of the base 462). Alternatively, the outer housing 108 can be molded separately and then permanently attached to the appliance housing. The wide portion 118 of the housing 108 can stick out of the handle 452 to allow the male connector 102 to be fully inserted into the female connector 104. In some implementations, the male connector 102 can be attached to the appliance 460 by a length of cable.

The electrical connector 100 can be used on many or all non-stationary electrical appliances, including hand-held appliances. For example, without limitation, the male connector 102 can be implemented in hair clippers, immersion blenders, tea makers, vacuums, clothing irons, clothing steamers, etc.

Figure 14:
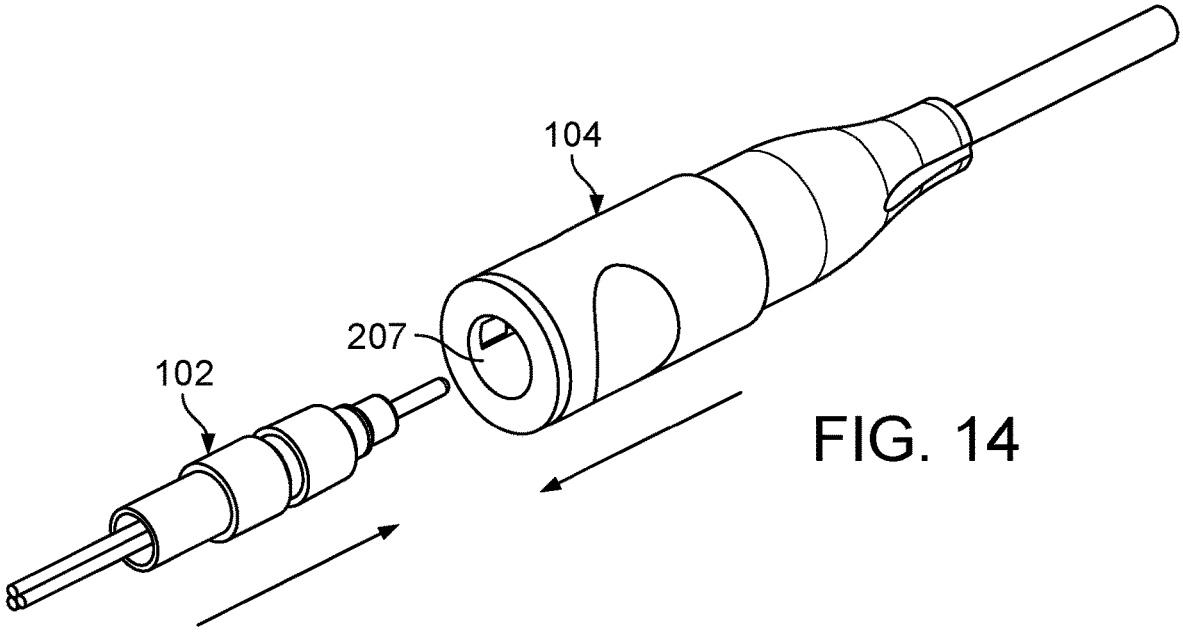
FIGS. 14-16 are schematic, perspective views of sequential steps of plugging a male connector into a female connector.
Figure 15:
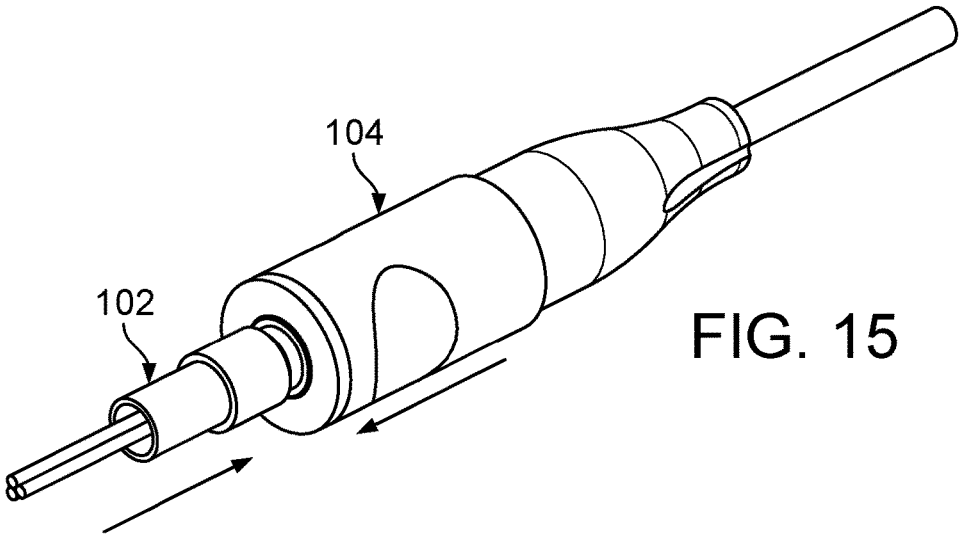
Figure 16:
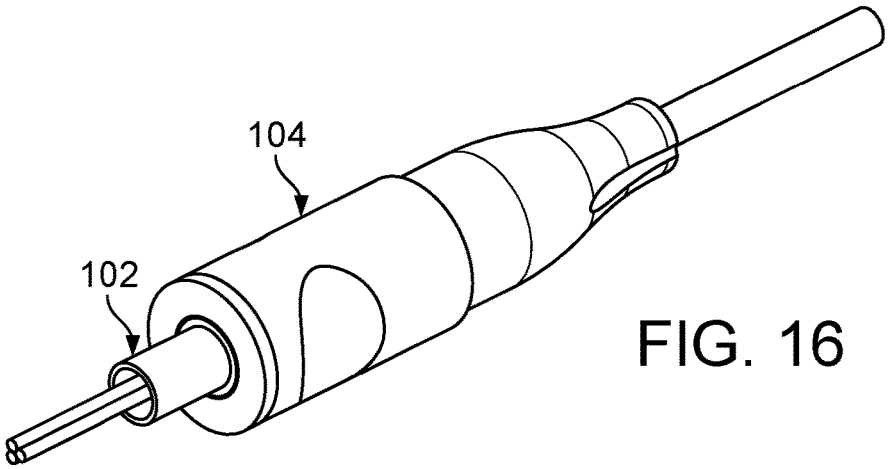

FIGS. 14-16 show sequential steps of connecting the male connector 102 with the female connector 104. As shown in FIG. 14, the male connector 102 is first aligned with the female connector such that the tip of the male connector 102 is aligned with the opening and the bore 207 of the female connector 104. Then, the male connector 102 and the female connector 104 are brought together by moving both connectors 102, 104 toward each other or by moving one of the connectors 102, 104 toward the other one of the connectors 102, 104. As shown in FIG. 15, once the male connector 102 is disposed inside the bore 207 of the female connector 104, the male connector is moved further into the bore 207 of the female connector 104 until the latch of the female connector 104 engages the outer housing of the male connector 102. As shown in FIG. 16, the male connector 102 is fully connected to the female connector 104 once the latch of the female connector 104 engages the outer housing of the male connector 102. The latch of the female connector 104 prevents the male connector 102 from being unplugged from the female connector 104. To disconnect the connectors 102, 104, the spring-loaded sleeve of the female connector 104 is pulled back until the latch of the female connector 104 disengages the outer sleeve of the male connector 102. Once the latch is disengaged, the male connector 102 can be pulled out and away from the female connector 104.

Figure 17:
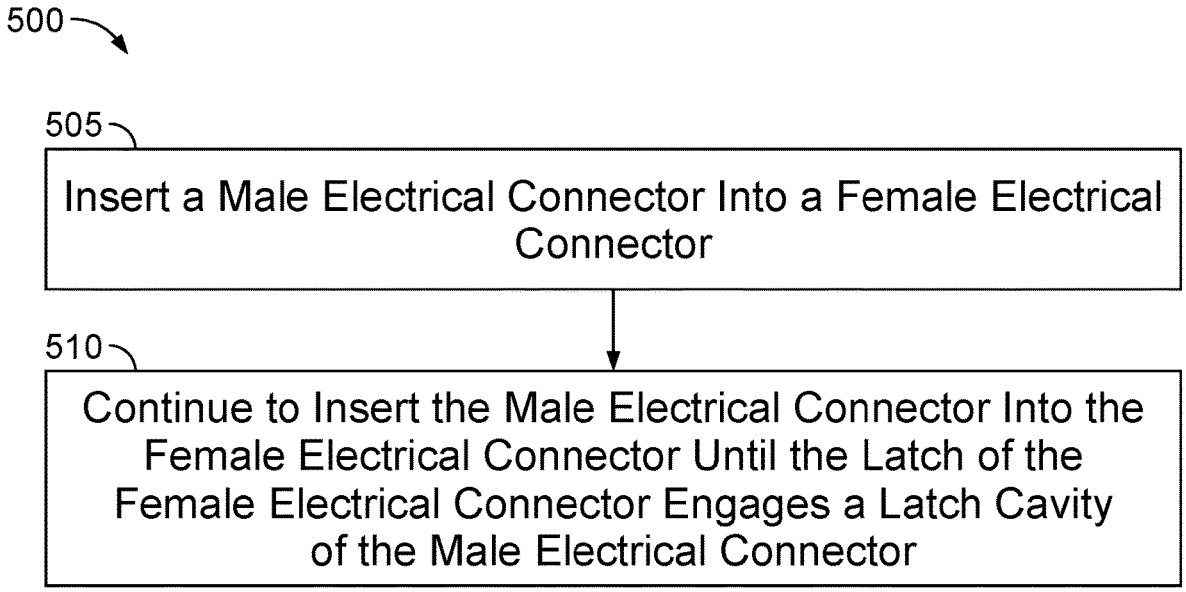
FIG. 17 is a flow chart of an example method of using the electrical connector.

FIG. 17 shows a flow chart of an example method 500 of using the electrical connector (e.g., the electrical connector 100 in FIG. 1). The method includes inserting a male electrical connector into a female electrical connector. The male electrical connector includes a non-conductive housing, a first tubular conductor including a first contact surface defining a first outer diameter, and a second tubular conductor electrically isolated from and radially spaced from the first tubular conductor. The second tubular conductor has a second contact surface defining a second outer diameter smaller than the first outer diameter. The female electrical connector has an outer housing that has a latch and two electrical contacts that reside inside the outer housing. Each of the two electrical contacts electrically connect to a respective one of the contact surfaces of the male connector (505). The method also includes continuing to insert the male electrical connector into the female electrical connector until the latch of the female electrical connector engages a latch cavity of the male electrical connector (510).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A bayonet electrical connector, comprising:

a male connector comprising:

a non-conductive connector housing, a first tubular conductor carried by the connector housing and comprising an exposed first cylindrical contact surface, a second tubular conductor carried by the connector housing and electrically isolated from the first tubular conductor, the second tubular conductor comprising an exposed second cylindrical contact surface of a smaller diameter than, and axially spaced from, the first cylindrical contact surface, and an inner conductor carried by the connector housing and electrically isolated from the first and second tubular conductors, the inner conductor comprising an exposed contact surface spaced axially from the first and second cylindrical contact surfaces and of a smaller diameter than the second cylindrical contact surface; and a female connector comprising a non-conductive female connector housing and three electrical contacts axially spaced from each other along a bore of the female connector and carried by the female connector housing, each of the three electrical contacts configured to electrically connect, with the male connector engaged with the female connector, to a respective one of the contact surfaces of the male connector;

wherein the second tubular conductor is arranged concentric with respect to the first tubular conductor, and the inner conductor is arranged concentric with respect to the second tubular conductor; and wherein the first tubular conductor is electrically coupled to a first electrical wire of the male connector, the second tubular conductor is electrically coupled to a second electrical wire of the male connector, and the inner conductor comprises a pin electrically coupled to a third electrical wire of the male connector.

2. The bayonet electrical connector of claim 1, wherein the first tubular conductor comprises a first tab extending from a rim of the first tubular conductor opposite the first cylindrical contact surface and electrically coupled to the first electrical wire, and the second tubular conductor comprises a second tab opposing the first tab and extending from a rim of the second tubular conductor opposite the second cylindrical contact surface, the second tab electrically coupled to the second electrical wire.

3. The bayonet electrical connector of claim 1, wherein the second tubular conductor extends beyond the first cylindrical contact surface with respect to the non-conductive connector housing of the male connector, and the inner conductor extends beyond the second cylindrical contact surface with respect to the non-conductive connector housing of the male connector.

4. The bayonet electrical connector of claim 1, wherein the male connector further comprises:

a first tubular insulator disposed between and in contact with the first tubular conductor and the second tubular conductor, and a second tubular insulator disposed between and in contact with the second tubular conductor and the inner conductor.

5. A bayonet electrical connector, comprising:

a male connector comprising:

a non-conductive connector housing, a first tubular conductor carried by the connector housing and comprising an exposed first cylindrical contact surface, a second tubular conductor carried by the connector housing and electrically isolated from the first tubular conductor, the second tubular conductor comprising an exposed second cylindrical contact surface of a smaller diameter than, and axially spaced from, the first cylindrical contact surface, and an inner conductor carried by the connector housing and electrically isolated from the first and second tubular conductors, the inner conductor comprising an exposed contact surface spaced axially from the first and second cylindrical contact surfaces and of a smaller diameter than the second cylindrical contact surface; and a female connector comprising a non-conductive female connector housing and three electrical contacts axially spaced from each other along a bore of the female connector and carried by the female connector housing, each of the three electrical contacts configured to electrically connect, with the male connector engaged with the female connector, to a respective one of the contact surfaces of the male connector;

wherein the female connector comprises an internal engagement sleeve comprising a latch configured to engage, with the male connector inserted into the female connector, a latch cavity of the connector housing of the male connector to secure the female connector to the male connector.

6. The bayonet electrical connector of claim 5, wherein the electrical contacts comprise spring-loaded electrical contacts attached to the internal engagement sleeve.

7. The bayonet electrical connector of claim 5, wherein the female connector comprises a spring-loaded sleeve disposed outside the internal engagement sleeve and configured to move along a central longitudinal axis of the female connector housing such that movement toward an electrical cable of the female connector compresses a spring of the spring-loaded sleeve and moves the latch to disengage the latch from the latch cavity of the male connector.

8. The bayonet electrical connector of claim 7, wherein the spring-loaded sleeve comprises an inwardly projecting shoulder defining a tip configured to push, by movement of the spring-loaded sleeve toward the electrical cable of the female connector, the latch away from the latch cavity until the latch disengages the latch cavity.

9. The bayonet electrical connector of claim 8, further comprising a housing comprising an outer flange and an inner tube extending from the outer flange and disposed at least partially inside the spring-loaded sleeve, the spring disposed between a shoulder of the spring-loaded sleeve and a wall of the internal engagement sleeve such that, absent an external force, the spring pushes the shoulder of the spring-loaded sleeve toward the outer flange.

10. An electrical connector, comprising:

a male connector comprising:

a non-conductive housing, a first electrical conductor residing at least partially inside the non-conductive housing and comprising a first exposed contact surface defining a first outer diameter, and a second electrical conductor residing at least partially inside the first electrical conductor and electrically isolated from the first electrical conductor, the second electrical conductor comprising a second contact surface defining a second outer diameter smaller than the first outer diameter; and a female connector comprising an outer housing and two electrical contacts residing inside the outer housing, each of the two electrical contacts configured to electrically connect, with the male connector engaged with the female connector, to a respective one of the contact surfaces of the male connector;

wherein the female connector comprises an engagement sleeve comprising a snap latch configured to engage, with the male connector inserted into the female connector, an external latch cavity of the male connector to secure the female connector to the male connector.

11. The electrical connector of claim 10, wherein the first electrical conductor comprises a tubular body carried by the non-conductive housing and the second electrical conductor comprises a second tubular body carried by the non-conductive housing, the male connector further comprising an insulating layer disposed between the first and second electrical conductors.

12. The electrical connector of claim 11, wherein the male connector further comprises a third electrical conductor electrically isolated from and concentric with respect to the second electrical conductor, the third electrical conductor comprising a third contact surface defining a third outer diameter smaller than the second outer diameter.

13. The electrical connector of claim 12, wherein the third electrical conductor is a pin axially spaced from and residing partially inside the second electrical conductor, the third contact surface comprising a pin end that extends beyond the second contact surface.

14. The electrical connector of claim 10, wherein the female connector comprises a spring-loaded sleeve disposed outside the engagement sleeve and configured to move along a central longitudinal axis of the outer housing such that movement toward an electrical cable of the female connector compresses a spring of the spring-loaded sleeve and moves the latch to disengage the latch from the latch cavity of the male connector.

15. The electrical connector of claim 14, wherein the spring-loaded sleeve comprises an inwardly projecting shoulder defining a tip configured to push, by movement of the spring-loaded sleeve toward the electrical cable of the female connector, the latch away from the latch cavity until the latch disengages the latch cavity.

16. A method of using an electrical connector, the method comprising:

inserting a male electrical connector into a female electrical connector, the male electrical connector comprising a non-conductive housing, a first tubular conductor comprising a first contact surface defining a first outer diameter, and a second tubular conductor electrically isolated from and radially spaced from the first tubular conductor, the second tubular conductor comprising a second contact surface defining a second outer diameter smaller than the first outer diameter, and the female electrical connector comprising an outer housing comprising a latch and two electrical contacts residing inside the outer housing, each of the two electrical contacts configured to electrically connect to a respective one of the contact surfaces of the male connector; and continuing to insert the male electrical connector into the female electrical connector until the latch of the female electrical connector engages a latch cavity of the male electrical connector.

17. The method of claim 16, further comprising pulling a sleeve of the female electrical connector away from the male electrical connector, disengaging the latch and thereby disconnecting the female electrical connector from the male electrical connector.

* * * * *